US010658741B1

(12) United States Patent
Zekios et al.

(10) Patent No.: US 10,658,741 B1
(45) Date of Patent: May 19, 2020

(54) RECONFIGURABLE AND FOLDABLE MULTIMODE MIMO ANTENNA

(71) Applicants: Constantinos L. Zekios, Miami, FL (US); Stavros Georgakopoulos, Miami, FL (US)

(72) Inventors: Constantinos L. Zekios, Miami, FL (US); Stavros Georgakopoulos, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/454,448

(22) Filed: Jun. 27, 2019

(51) Int. Cl.
*H01Q 7/00* (2006.01)
*H01Q 1/38* (2006.01)

(52) U.S. Cl.
CPC ..... *H01Q 1/38* (2013.01)

(58) Field of Classification Search
None
See application file for complete search history.

(56) References Cited

U.S. PATENT DOCUMENTS

| | | | | |
|---|---|---|---|---|
| 9,214,722 | B2 * | 12/2015 | Georgakopoulos | H01Q 1/36 |
| 9,847,570 | B2 * | 12/2017 | Georgakopoulos | H01Q 1/08 |
| 10,020,586 | B1 * | 7/2018 | Georgakopoulos | H01Q 11/10 |
| 10,347,962 | B1 * | 7/2019 | Georgakopoulos | H01Q 1/085 |
| 2006/0187124 | A1 * | 8/2006 | Goldberg | H01Q 1/38 343/700 MS |
| 2017/0025748 | A1 * | 1/2017 | Georgakopoulos | H01Q 1/08 |
| 2018/0278200 | A1 * | 9/2018 | Jeon | F16M 11/2085 |

* cited by examiner

*Primary Examiner* — Trinh V Dinh
(74) *Attorney, Agent, or Firm* — Saliwanchik, Lloyd & Eisenschenk

(57) ABSTRACT

Multiple-input-multiple-output (MIMO) antenna devices and methods of using and fabricating the same are provided. A MIMO antenna device can include a substrate that is capable of being folded and an antenna element disposed thereon. The antenna element can be disposed on the substrate in a polygon shape such as a rectangle or a square. The substrate can have predefined folding lines such that the substrate can be folded into different positions.

20 Claims, 10 Drawing Sheets

101

102

103

State 1

State 2

State 3

State 4

State 5

State 6

RECONFIGURABLE AND FOLDABLE MULTIMODE MIMO ANTENNA

GOVERNMENT SUPPORT

This invention was made with government support under Grant Number FA9550-18-1-0191 awarded by the Air Force. The government has certain rights in the invention.

BACKGROUND

Multiple-input-multiple-output (MIMO) antenna devices multiply the capacity of a radio link using multiple transmission and receiving antennas to exploit multipath propagation. MIMO has become an essential element of wireless communication standards including IEEE 802.11n (Wi-Fi), IEEE 802.11ac (Wi-Fi), 4G LTE, and 5G, among others. MIMO can also be applied to power-line communication.

BRIEF SUMMARY

Embodiments of the subject invention provide novel and advantageous multiple-input-multiple-output (MIMO) antenna devices and methods of using and fabricating the same. A MIMO antenna device can include a substrate (e.g., an origami substrate that is capable of being folded) and an antenna element (e.g. a looped antenna element) disposed (e.g., printed) on the substrate. The antenna element can be disposed on the substrate in a polygon shape such as a rectangle or a square, though embodiments are not limited thereto. The antenna element can have a looped shape that matches that of the (border of) the substrate. The substrate can have predefined folding lines (e.g., folding lines for mountain- and/or valley-style folds) such that the substrate can be folded into different positions, which can be referred to as different states of the antenna device. The substrate can be a dielectric substrate.

The MIMO antenna devices of embodiments of the subject invention can simultaneously operate at different modes by changing their shape. Different modes refers to different current distribution that operate at different frequencies and produce different radiation patterns. An origami-inspired mechanism (e.g., use of an origami substrate with predefined folding patters) can be used to accommodate the physical reconfiguration of the MIMO system. The devices can be also used for spatial modulation, exploiting the dynamic and real time spatial reconfiguration thereof. Spatial modulation refers to each different (folded) state of the reconfigurable antenna being used as a source of information. For example, the antenna device can be used as a code mechanism that can be referred to as transmit-antenna index coded modulation.

In an embodiment, a MIMO antenna device can comprise: a foldable substrate configured to be folded; and an antenna element disposed on the foldable substrate. The foldable substrate can be an origami substrate, for example a waterbomb origami substrate, that has predefined folding lines and/or hinges for folding into a predetermined configuration (e.g., a waterbomb configuration), such that the MIMO antenna device has an unfolded state and a plurality of folded states. The antenna element can be provided in singularity such that no other antenna element is present on the foldable substrate, though embodiments are not limited thereto. The foldable substrate can be a dielectric substrate, though embodiments are not limited thereto.

In another embodiment, a method of fabricating a MIMO antenna device can comprise: providing foldable substrate configured to be folded; forming (e.g., printing) an antenna element (e.g., a looped antenna element) on the foldable substrate; and folding the foldable substrate with the antenna element formed thereon to create folding lines such that it is configured to be folded into a predetermined configuration (e.g., such that the foldable substrate with folding lines is an origami substrate such as a waterbomb origami substrate that is configured to be folded into a waterbomb configuration), such that the MIMO antenna device has an unfolded state and a plurality of folded states. The antenna element can be provided in singularity such that no other antenna element is present on the foldable substrate, though embodiments are not limited thereto. The foldable substrate can be a dielectric substrate, though embodiments are not limited thereto.

BRIEF DESCRIPTION OF DRAWINGS

FIG. 3A shows a first (unfolded) state; FIG. 3B shows a second (folded) state; FIG. 3C shows a third (folded) state; FIG. 3D shows a fourth (folded) state; FIG. 3E shows a fifth (folded) state; and FIG. 3F shows a sixth (folded) state.

FIGS. 4A-4F show the characteristics for the states of FIGS. 3A-3F, respectively.

FIGS. 5A-5F show the characteristics for the states of FIGS. 3A-3F, respectively.

FIGS. 6A-6F show the characteristics for the states of FIGS. 3A-3F, respectively. The characteristics in FIGS. 6A-6F are for a different mode of operation than those shown in FIGS. 4A-4F.

FIGS. 7A-7F show the characteristics for the states of FIGS. 3A-3F, respectively. The characteristics in FIGS. 7A-7F are for a different mode of operation than those shown in FIGS. 5A-5F.

DETAILED DESCRIPTION

Embodiments of the subject invention provide novel and advantageous multiple-input-multiple-output (MIMO) antenna devices and methods of using and fabricating the same. A MIMO antenna device can include a substrate (e.g., an origami substrate that is capable of being folded) and an antenna element (e.g. a looped antenna element) disposed (e.g., printed) on the substrate. The antenna element can be disposed on the substrate in a polygon shape such as a rectangle or a square, though embodiments are not limited thereto. The antenna element can have any shape (e.g., a looped shape) that matches that of the (border of) the substrate. The substrate can have predefined folding lines (e.g., folding lines for mountain- and/or valley-style folds) such that the substrate can be folded into different positions, which can be referred to as different states of the antenna device. The substrate can be a dielectric substrate.

The MIMO antenna devices of embodiments of the subject invention can simultaneously operate at different modes by changing their shape. Different modes refers to different current distributions that operate at different frequencies and produce different radiation patterns. An origami-inspired mechanism (e.g., use of an origami substrate with predefined folding patters) can be used to accommodate the physical reconfiguration of the MIMO system. The devices can be also used for spatial modulation, exploiting the dynamic and real time spatial reconfiguration thereof. Spatial modulation refers to each different (folded) state of the reconfigurable antenna being used as a source of information. For example, the antenna device can be used as a code mechanism that can be referred to as transmit-antenna index coded modulation.

Figure 1:
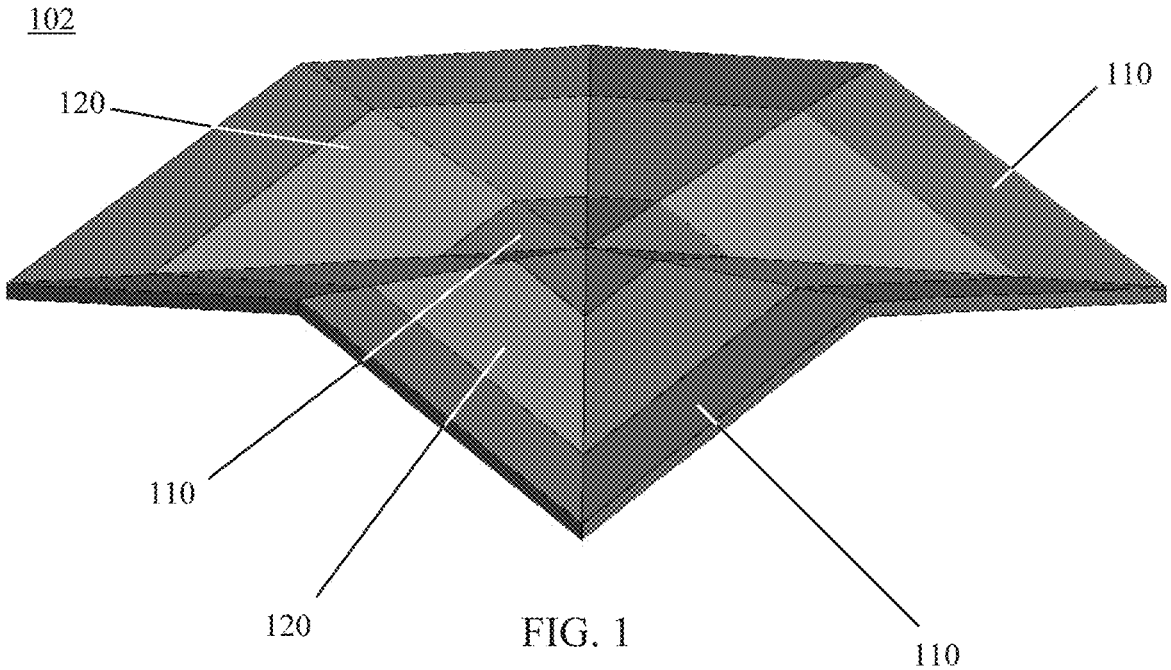
FIG. 1 is a schematic view showing a multiple-input-multiple-output (MIMO) antenna device in a folded state, according to an embodiment of the subject invention.
Figure 2:
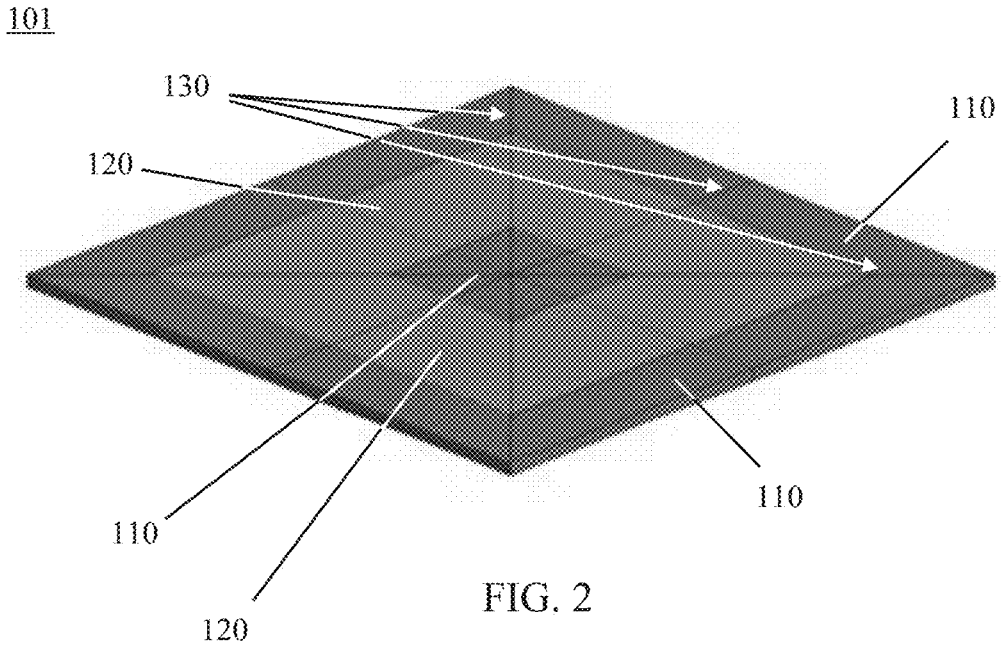
FIG. 2 is a schematic view showing a MIMO antenna device in an unfolded state, according to an embodiment of the subject invention.

FIG. 1 is a schematic view showing a MIMO antenna device in a folded state 102, according to an embodiment of the subject invention; and FIG. 2 is a schematic view showing the antenna device of FIG. 1 in an unfolded state 101. Referring to FIGS. 1 and 2, the antenna device comprises a substrate 110 and an antenna element 120 disposed on the substrate. The antenna element 120 can be a looped antenna element such that the antenna element loops back around and connects to itself. For example, the antenna element 120 can be disposed on the substrate in a polygon shape, such as a rectangle or a square. The antenna device can include only a single antenna element, though alternative embodiments can include multiple antenna elements. FIGS. 1 and 2 depict a single square looped antenna element.

The substrate 110 can be an origami substrate capable of being folded without damaging the substrate. The substrate 110 can have predefined folding lines 130 (e.g., folding lines for mountain- and/or valley-style folds) such that the substrate 110 can be folded into different positions, which can be referred to as different states of the antenna device. Only some of the folding lines are identified by the reference numeral 130 in FIG. 1; others can be seen in the figure. The substrate 110 can be a waterbomb origami substrate, which is a substrate with a set of folding patterns for folding into a particular shape, and which is shown in FIGS. 1-3F. That is, the substrate 110 depicted in FIGS. 1-3F is a waterbomb origami substrate, which can also be referred to as a waterbomb. The waterbomb origami substrate is shown for exemplary purposes only, and embodiments are not limited thereto.

Figure 3A:
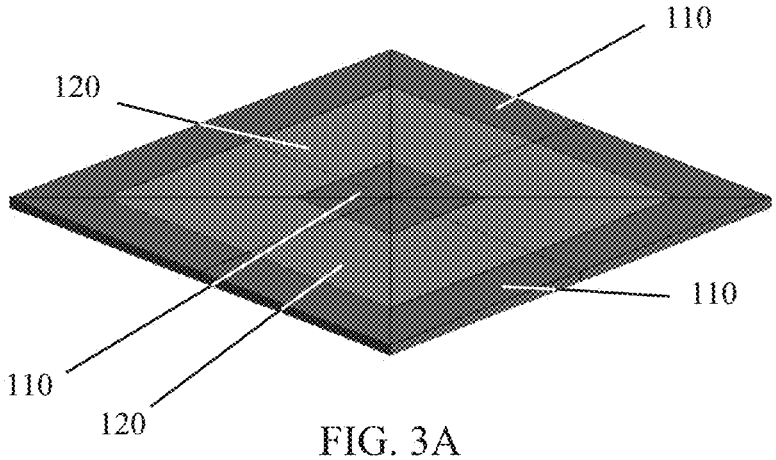
FIGS. 3A-3F are schematic views showing a MIMO antenna device in an unfolded state and then in several consecutive folded states, according to an embodiment of the subject invention.
Figure 3B:
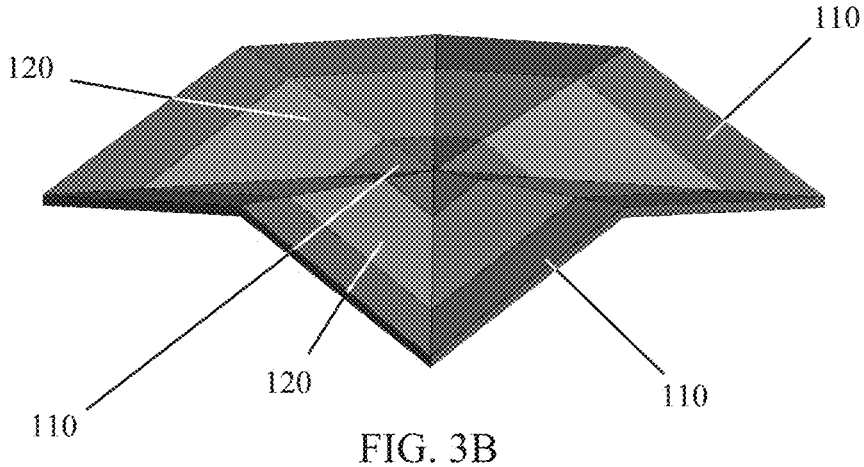
Figure 3C:
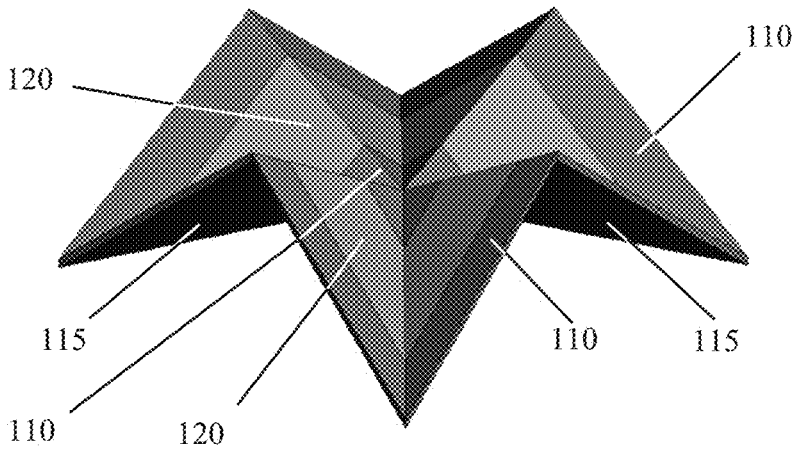
Figure 3D:
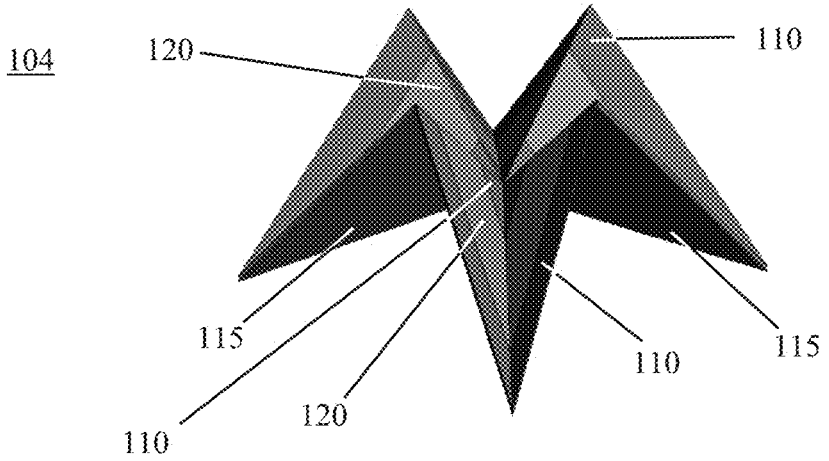
Figure 3E:
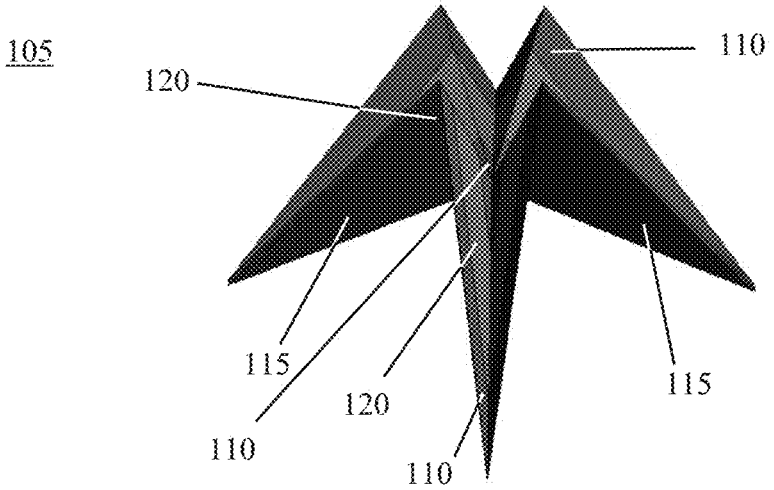
Figure 3F:
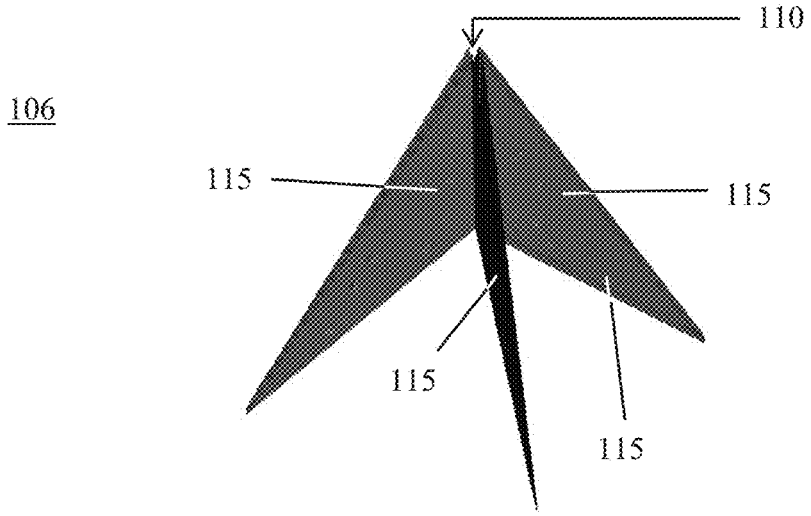
Figure 4A:
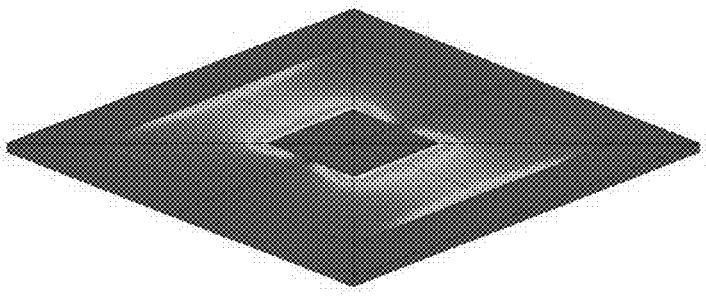
FIGS. 4A-4F are schematic views showing current distribution characteristics of a MIMO antenna device in an unfolded state and then in several consecutive folded states, according to an embodiment of the subject invention.
Figure 4B:
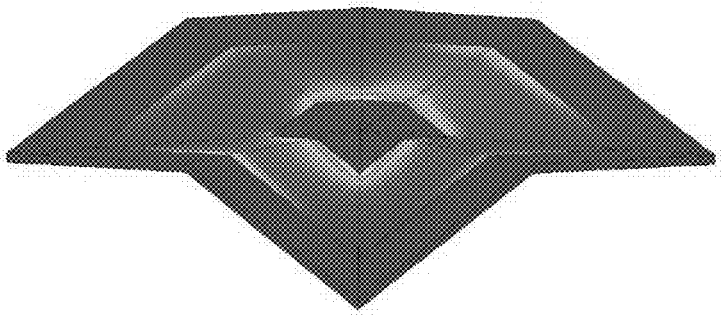
Figure 4C:
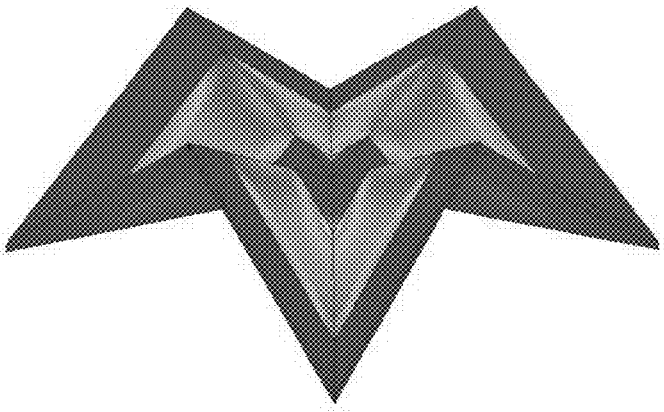
Figure 4D:
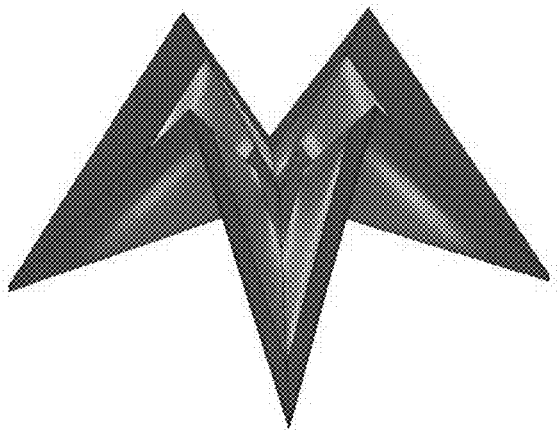
Figure 4E:
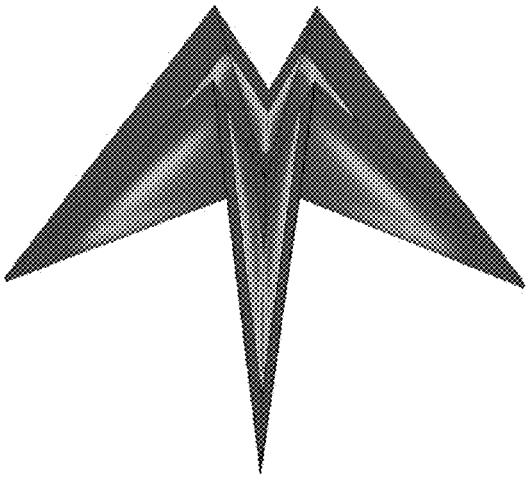
Figure 4F:
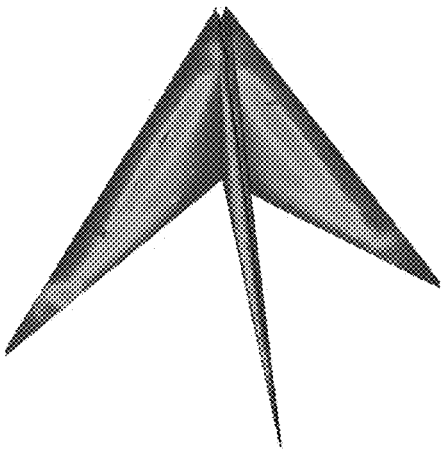
Figure 5A:
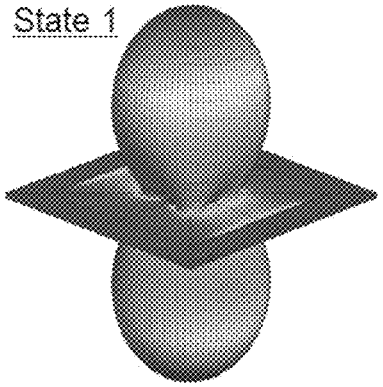
FIGS. 5A-5F are schematic views showing radiation characteristics of a MIMO antenna device in an unfolded state and then in several consecutive folded states, according to an embodiment of the subject invention.
Figure 5B:
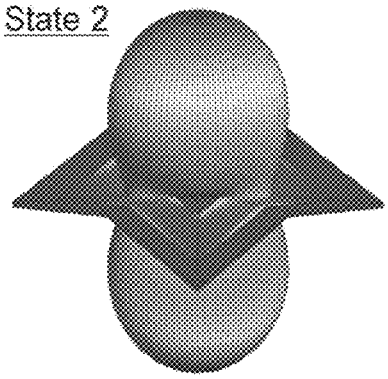
Figure 5C:
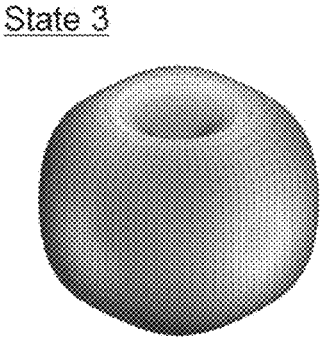
Figure 5D:
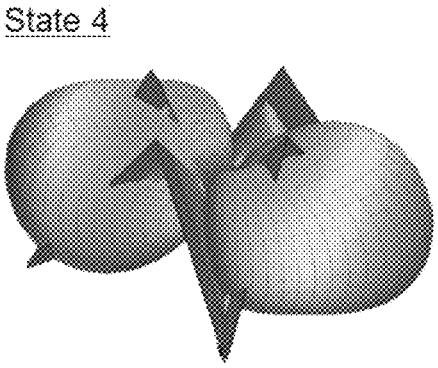
Figure 5E:
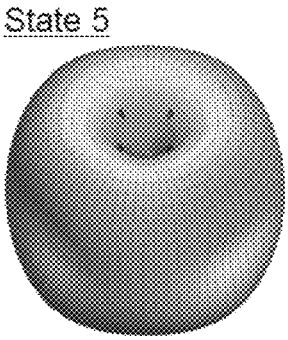
Figure 5F:
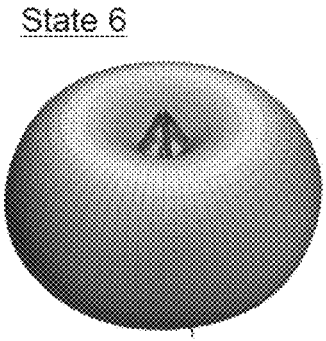
Figure 6A:
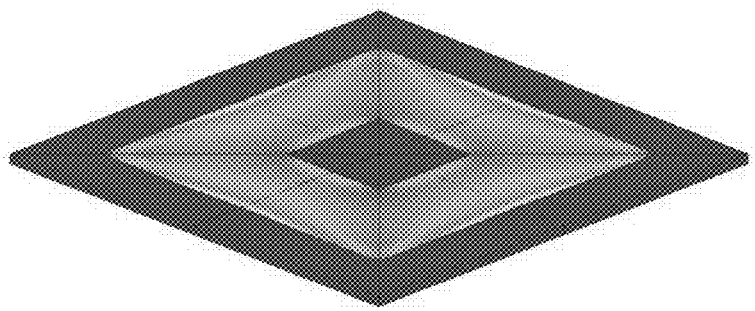
FIGS. 6A-6F are schematic views showing current distribution characteristics of a MIMO antenna device in an unfolded state and then in several consecutive folded states, according to an embodiment of the subject invention.
Figure 6B:
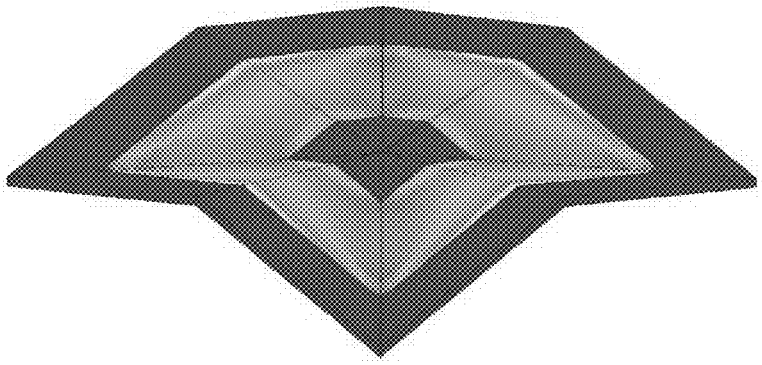
Figure 6C:
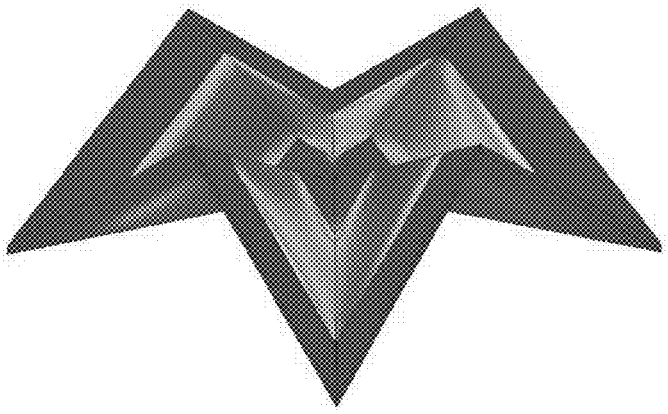
Figure 6D:
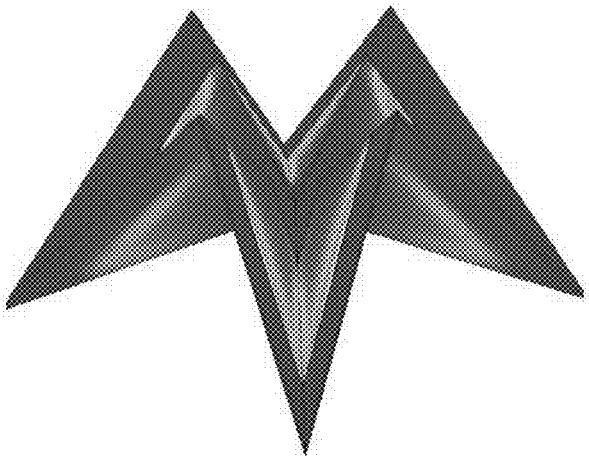
Figure 6E:
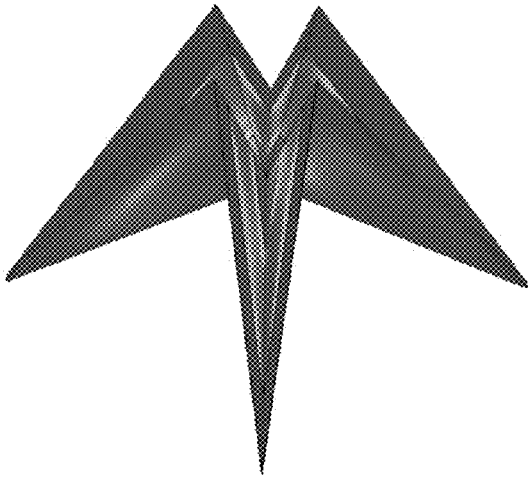
Figure 6F:
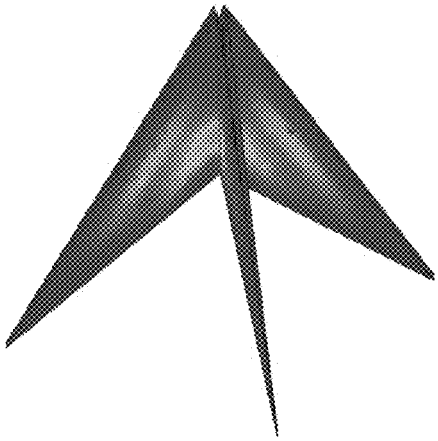
Figure 7A:
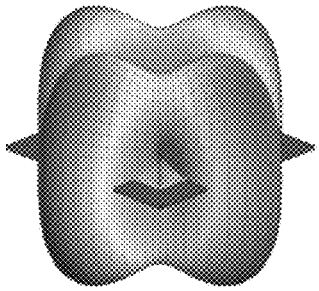
FIGS. 7A-7F are schematic views showing radiation characteristics of a MIMO antenna device in an unfolded state and then in several consecutive folded states, according to an embodiment of the subject invention.
Figure 7B:
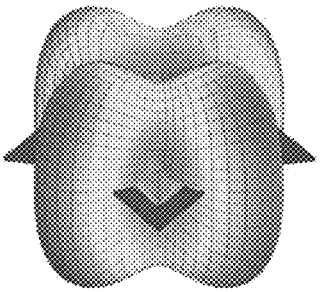
Figure 7C:
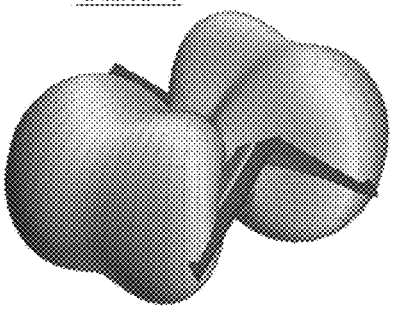
Figure 7D:
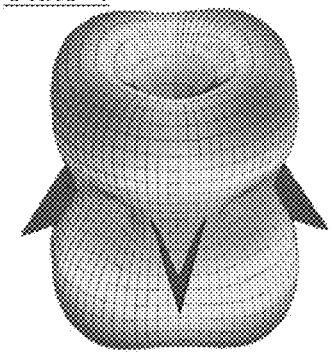
Figure 7E:
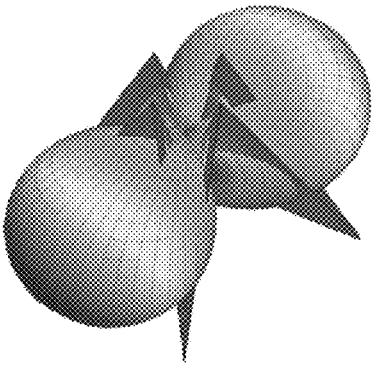
Figure 7F:
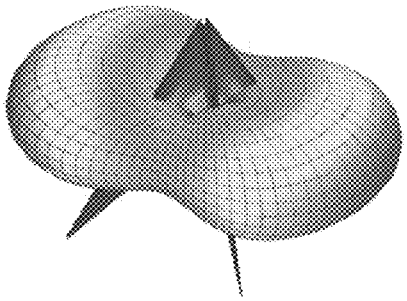

FIGS. 3A-3F are schematic views showing the antenna device of FIGS. 1 and 2 in an unfolded state and then in several consecutive folded states. FIG. 3A shows a first (unfolded) state; FIG. 3B shows a second (folded) state; FIG. 3C shows a third (folded) state; FIG. 3D shows a fourth (folded) state; FIG. 3E shows a fifth (folded) state; and FIG. 3F shows a sixth (folded) state. Referring to FIGS. 3A-3F, the unfolded antenna device 101 can be folded along the folding lines 130 first into the first folded state, which is referred to as a "second state" 102 (the first state being the unfolded state), then to a third state 103, a fourth state 104, a fifth state 105 and then a final sixth state 106. In FIGS. 3A-3F, the bottom surface of the substrate 110 (the opposite surface from that on which the antenna element 120 is disposed) is identified with reference numeral 115. It is noted that reference numeral 110 points to the upper surface (the surface on which the antenna element 120 is disposed) of the substrate in every instance.

The substrate can be a dielectric substrate. The substrate can be any suitable material known in the art, such as paper, cardboard, plastic, FR4, Kapton, or Duroid. The substrate can have a thickness of any of the following values, at least any of the following values, about any of the following values, no more than any of the following values, or within any range having any of the following values as endpoints (all values are in millimeter (mm)): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, or 15. These values are exemplary only and should not be construed as limiting. The total thickness of the substrate and the antenna element can be any of the following values, at least any of the following values, about any of the following values, no more than any of the following values, or within any range having any of the following values as endpoints (all values are in mm): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, 20, 21, 22, 23, 24, 25, 25.4, 26, 27, 28, 29, or 30. These values are exemplary only and should not be construed as limiting. Any thickness can be used as long as the substrate can fold without breaking (e.g., by folding itself or by folding using hinges).

The antenna element can be configured to operate at a desired frequency or multiple such frequencies. In many embodiments, the antenna element can be configured to operate at any frequency (e.g., a frequency in a range of from 2 gigahertz (GHz) to 3 GHz). For example, the antenna element can be configured to operate at a frequency of any of the following values, at least any of the following values, about any of the following values, no more than any of the following values, or within any range having any of the following values as endpoints (all values are in millimeter (GHz)): 2.0, 2.1, 2.2, 2.3, 2.4, 2.5, 2.6, 2.7, 2.8, 2.9, or 3.0. These values are exemplary only and should not be construed as limiting. For example, the antenna design can be scaled up or down to obtain any desired frequency.

The material for the antenna element can be any suitable material known in the art. For example, the antenna element can be copper, aluminum, gold, silver, or platinum.

In an embodiment, a method fabricating a MIMO antenna device can comprise providing a substrate and forming (e.g., printing) an antenna element thereon. The antenna element can be formed on the substrate using any suitable technique(s) known in the art. The substrate with antenna element can then be folded to create the folding lines. In an alternative embodiment, the folding lines can be created before forming the antenna element or the substrate can already have folding lines before the method begins. Once the antenna element and the folding lines are present, the antenna device has been fabricated, and it can be folded into different states to reconfigure its electromagnetic (EM) characteristics as desired. The substrate can include hinges for folding instead of folding lines.

MIMO antenna devices of embodiments of the subject invention can adjust their EM characteristics based on a user's requests/desires and/or based on environmental requirements (e.g., from an EM point of view). The ability to change shape (into different states (unfolded or multiple folded states) allow the antenna device to operate at different modes. The antenna devices can be also used for spatial modulation, exploiting the ability of the devices to spatially reconfigure dynamically and in real time.

The ability of the antenna devices of embodiments of the subject invention to deform their shape and operate at different modes offers an extended multi-functionality by covering different frequency bands and with different radiation patterns with the use of just a single antenna element. The ability of the antenna device to change its radiation pattern and mode of use can be advantageously used for network (e.g., 5G), internet-of-things (IoT), and similar applications that demand antenna systems that can cover multiple frequency bands and with different polarizations so they can receive and transmit signals simultaneously. MIMO antenna devices of embodiments of the subject invention can be used for multi-functional communications, deployable and collapsible antennas, polarization diversity, and network and IoT applications.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

A MIMO antenna device as shown in FIGS. 1-3F was fabricated on a waterbomb origami substrate by printing a single square loop antenna element on the substrate. The antenna element was configured to operate at a frequency in a range of from 2 GHz to 3 GHz. A characteristic mode analysis was performed. A first mode was analyzed with an operation frequency at 2.0 GHz.

FIGS. 4A-4F show current distribution characteristics of the antenna device in an unfolded state and then in several consecutive folded states; FIGS. 4A-4F show the characteristics for the states of FIGS. 3A-3F, respectively. FIGS. 5A-5F show radiation characteristics of the antenna device in an unfolded state and then in several consecutive folded states, according to an embodiment of the subject invention; FIGS. 5A-5F show the characteristics for the states of FIGS. 3A-3F, respectively.

Figure 8A:
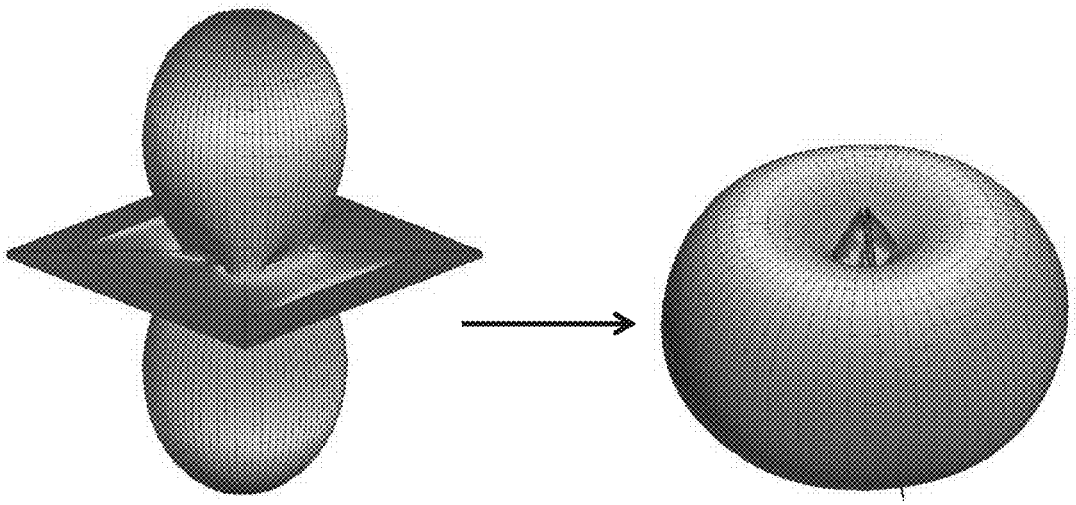
FIG. 8A shows a side-by-side comparison of radiation characteristics of an antenna in a first (unfolded) state (left side of figure) and a sixth (folded) state (right side of figure) operating at the same mode that was used for FIGS. 5A-5F. The left and right portions of FIG. 8A correspond to FIGS. 5A and 5F, respectively.

FIG. 8A shows a side-by-side comparison of radiation characteristics of the antenna in a first (unfolded) state (left side of figure) and a sixth (folded) state (right side of figure). The left and right portions of FIG. 8A correspond to FIGS. 5A and 5F, respectively. The radiation pattern of the unfolded state can be referred to as "broadside", and the radiation pattern of the sixth state can be referred to as "omnidirectional".

Example 2

Example 1 was repeated, but for a second mode with an operation frequency at 2.6 GHz.

FIGS. 6A-6F show current distribution characteristics of the antenna device in an unfolded state and then in several consecutive folded states; FIGS. 6A-6F show the characteristics for the states of FIGS. 3A-3F, respectively. FIGS. 7A-7F show radiation characteristics of the antenna device in an unfolded state and then in several consecutive folded states, according to an embodiment of the subject invention; FIGS. 7A-7F show the characteristics for the states of FIGS. 3A-3F, respectively.

Figure 8B:
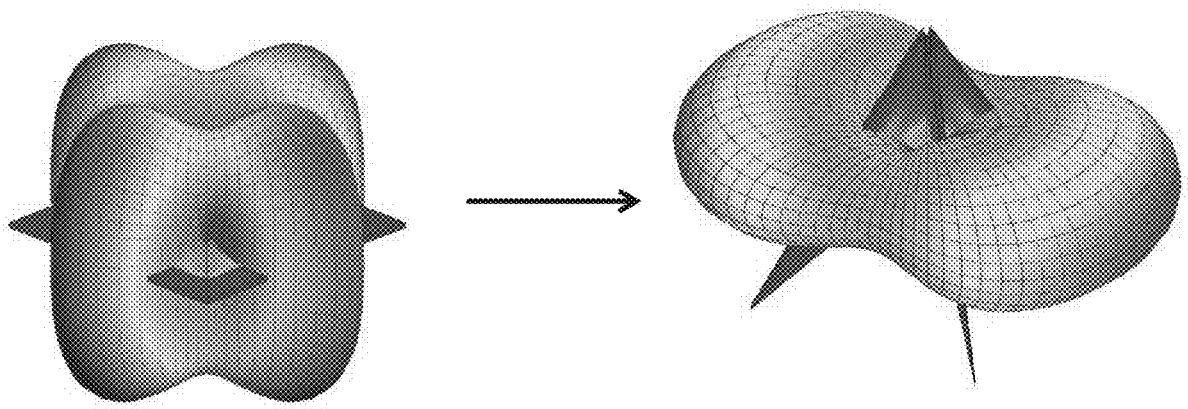
FIG. 8B shows a side-by-side comparison of radiation characteristics of an antenna in a first (unfolded) state (left side of figure) and a sixth (folded) state (right side of figure) operating at the same mode that was used for FIGS. 7A-7F. The left and right portions of FIG. 8B correspond to FIGS. 7A and 7F, respectively.

FIG. 8B shows a side-by-side comparison of radiation characteristics of the antenna in a first (unfolded) state (left side of figure) and a sixth (folded) state (right side of figure). The left and right portions of FIG. 8B correspond to FIGS. 7A and 7F, respectively. The radiation pattern of the unfolded state can be referred to as "four main lobes", and the radiation pattern of the sixth state can be referred to as "end-fire".

Referring to FIGS. 4A-8B, it can be seen that the antenna device has different characteristics at different states (unfolded or the many folded) and also has different characteristics at different operating frequencies. It can plainly be seen that the antenna device can operate at different modes, produce different radiation patterns, and provide spatial modulation all by simply changing the shape (easily, by folding/unfolding) and/or frequency of operation.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A multiple-input-multiple-output (MIMO) antenna device, comprising:

a foldable substrate configured to be folded, the foldable substrate being a dielectric substrate; and an antenna element disposed on the foldable substrate, the foldable substrate having predefined folding lines, hinges, or both, for folding into a predetermined configuration, such that the MIMO antenna device has an unfolded state and a plurality of folded states, and the antenna element being a looped antenna element such that the antenna element loops back around and connects to itself.

2. The MIMO antenna device according to claim 1, the looped antenna element being disposed on the foldable substrate in a square shape.

3. The MIMO antenna device according to claim 1, the looped antenna element being disposed on the foldable substrate in a polygon shape.

4. The MIMO antenna device according to claim 1, the looped antenna element being disposed on the foldable substrate in a shape that is the same as that of an outer border of the foldable substrate.

5. The MIMO antenna device according to claim 1, the foldable substrate being an origami substrate having the predefined folding lines.

6. The MIMO antenna device according to claim 1, the foldable substrate being a waterbomb origami substrate having the predefined folding lines for folding into a waterbomb configuration.

7. The MIMO antenna device according to claim 1, the foldable substrate having a thickness of less than 30.0 millimeters (mm).

8. The MIMO antenna device according to claim 1, the foldable substrate comprising paper, cardboard, plastic, FR4, Kapton, or Duroid.

9. The MIMO antenna device according to claim 1, the antenna element being configured to operate at a frequency in a range of from 2.0 gigahertz (GHz) to 3 GHz.

10. The MIMO antenna device according to claim 1, the antenna element comprising copper, aluminum, gold, silver, or platinum.

11. The MIMO antenna device according to claim 1, the MIMO antenna device being configured to operate at different respective modes and produce respective different radiation patterns at the unfolded state and different folded states of the plurality of folded states.

12. The MIMO antenna device according to claim 1, the antenna element being provided in singularity such that no other antenna element is present on the foldable substrate.

13. The MIMO antenna device according to claim 1, the MIMO antenna device having a thickness of less than 30.0 mm.

14. The MIMO antenna device according to claim 1, the antenna element being printed on the foldable substrate.

15. A method of fabricating a multiple-input-multiple-output (MIMO) antenna device, the method comprising:

providing a foldable substrate configured to be folded, the foldable substrate being a dielectric substrate;

forming an antenna element on the foldable substrate; and folding the foldable substrate with the antenna element formed thereon to create folding lines such that the foldable substrate with folding lines is an origami substrate that is configured to be folded into a predetermined configuration, such that the MIMO antenna device has an unfolded state and a plurality of folded states, the antenna element being a looped antenna element such that the antenna element loops back around and connects to itself.

16. The method according to claim 15, the looped antenna element being disposed on the foldable substrate in a polygon shape, and the looped antenna element being disposed on the foldable substrate in a shape that is the same as that of an outer border of the foldable substrate.

17. The method according to claim 15, the folding of the foldable substrate comprising folding the foldable substrate with the looped antenna element formed thereon to create the folding lines such that the foldable substrate with the folding lines is a waterbomb origami substrate that is configured to be folded into a waterbomb configuration.

18. The method according to claim 15, the MIMO antenna device having a thickness of less than 30.0 millimeters (mm), the MIMO antenna device being configured to operate at different respective modes and produce respective different radiation patterns at the unfolded state and different folded states of the plurality of folded states, the origami substrate comprising paper, cardboard, plastic, FR4, Kapton, or Duroid, the looped antenna element comprising copper, aluminum, gold, silver, or platinum, and the forming of the antenna element comprising printing the antenna element on the origami substrate.

19. The method according to claim 15, the looped antenna element being provided in singularity such that no other antenna element is present on the origami substrate of the MIMO antenna device.

20. A multiple-input-multiple-output (MIMO) antenna device, comprising:

an origami substrate configured to be folded, the origami substrate being a dielectric substrate; and an antenna element disposed on the origami substrate, the antenna element being a looped antenna element such that the antenna element loops back around and connects to itself, the origami substrate being a waterbomb origami substrate that has predefined folding lines for folding into a waterbomb configuration, such that the MIMO antenna device has an unfolded state and a plurality of folded states, the looped antenna element being disposed on the origami substrate in a square shape, the looped antenna element being disposed on the origami substrate in a shape that is the same as that of an outer border of the origami substrate, the MIMO antenna device being configured to operate at different respective modes and produce respective different radiation patterns at the unfolded state and different folded states of the plurality of folded states, the looped antenna element being provided in singularity such that no other antenna element is present on the origami substrate, the MIMO antenna device having a thickness of less than 30.0 millimeters (mm), and the looped antenna element being printed on the origami substrate.

* * * * *